US006932683B2

(12) United States Patent
Li

(10) Patent No.: US 6,932,683 B2
(45) Date of Patent: Aug. 23, 2005

(54) KNIFE SHARPER HAVING CUTTING EDGE PROTECTIVE STRUCTURE

(76) Inventor: Sheng Cheng Li, P.O. Box 63-99, Taichung (TW), 406

( * ) Notice: Subject to any disclaimer, the term of this patent is extended or adjusted under 35 U.S.C. 154(b) by 313 days.

(21) Appl. No.: 10/608,793

(22) Filed: Jun. 24, 2003

(65) Prior Publication Data

US 2003/0236061 A1 Dec. 25, 2003

Related U.S. Application Data

(63) Continuation-in-part of application No. 10/305,908, filed on Nov. 27, 2002, now abandoned, which is a continuation-in-part of application No. 09/905,805, filed on Jul. 16, 2001, now abandoned.

(51) Int. Cl.[7] ..... B24B 7/00

(52) U.S. Cl. ..... 451/193; 451/234; 451/451; 451/454

(58) Field of Search ..... 451/45, 193, 196, 451/198, 234, 260, 278, 371, 451, 457, 454, 262

(56) References Cited

U.S. PATENT DOCUMENTS

| | | | | |
|---|---|---|---|---|
| 4,807,399 | A | 2/1989 | Friel | 51/109 BS |
| 5,245,789 | A | 9/1993 | Rees et al. | 51/80 BS |
| 5,397,262 | A | 3/1995 | Lii | 451/241 |
| 6,012,971 | A | 1/2000 | Friel, Sr. et al. | 451/45 |
| 6,071,181 | A | 6/2000 | Wightman et al. | 451/192 |

*Primary Examiner*—Eileen P. Morgan
(74) *Attorney, Agent, or Firm*—Charles E. Baxley

(57) ABSTRACT

A knife sharpener includes a housing having one or more access slots for receiving knife blades to be sharpened, one or more grinding wheels rotatably received in the housing and disposed close to the access slots of the housing for grinding and sharpening the cutting edges of the knife blades. The housing includes one or more openings formed in either or both of the end portions of the access slot of the housing and communicating with the access slot of the housing, and having a width greater than that of the end portions of the access slot of the housing, for receiving and preventing the cutting edge of the knife blade from being blunted by the housing after sharpened by the grinding wheel.

8 Claims, 8 Drawing Sheets

KNIFE SHARPER HAVING CUTTING EDGE PROTECTIVE STRUCTURE

The present invention is a continuation-in part of U.S. patent application Ser. No. 10/305,908, filed 27 Nov. 2002, entitled: ELECTRIC KNIFE SHARPENING DEVICE, to be abandoned, which is a continuation-in part of U.S. patent application Ser. No. 09/905,805, filed 16 Jul. 2001, entitled: ELECTRIC KNIFE SHARPENING DEVICE, abandoned.

BACKGROUND OF THE INVENTION

1. Field of the Invention

The present invention relates to a knife grinder or a knife sharpener, and more particularly to a knife sharpener having a knife blade cutting edge protective structure.

2. Description of the Prior Art

Various kinds of typical knife sharpeners, particularly typical electrical knife sharpening facilities or devices have been developed for easily and quickly sharpening or grinding the cutting edges of the knife blades, and comprise one or more sharpening or grinding wheels rotatably secured in a housing and each having one or more abrading surfaces for sharpening or grinding the cutting edges of the knife blades.

For example, U.S. Pat. No. 4,807,399 to Friel, U.S. Pat. No. 5,245,789 to Rees et al., U.S. Pat. No. 5,397,262 to Lii, U.S. Pat. No. 6,012,971 to Friel, Sr. et al., and U.S. Pat. No. 6,071,181 to Wightman et al. disclose five of the typical electrical knife sharpening facilities or devices, and each comprises one or more rotatable sharpening or grinding wheels each having one or more abrading surfaces for sharpening or grinding the cutting edges of the knife blades.

The housing for rotatably receiving the sharpening or grinding wheels includes one or more access slots formed or defined by one or more blade guide surfaces, for receiving and guiding the knife blades through the sharpening or grinding wheels, and thus for allowing the knife blades to be suitably sharpened or honed by the sharpening or grinding wheels.

While sharpening or grinding the knife blades, the knife blades are required to be engaged into and passed through the access slots of the housing a suitable number of times, in order to repeat sharpening or grinding the knife blades several times before the knife blades may be suitably sharpened or honed.

However, the access slots of the housing normally include a sharp corner or end formed or defined by the blade guide surfaces. After the knife blades have been sharpened or honed by the sharpening or grinding wheels, the sharpened or honed cutting edges of the knife blades may be moved through the sharp corners or ends of the access slots of the housing, and will be engaged with the blade guide surfaces of the housing.

Accordingly, before completely sharpening or honing the knife blades and before the knife blades are removed from the housing, the cutting edges of the knife blades that have just been honed or sharpened by the sharpening or grinding wheels may thus be caused or moved to be engaged with the blade guide surfaces of the housing, when the sharpened or honed cutting edges of the knife blades are moved through and engaged with the blade guide surfaces of the housing, such that the sharpened or honed cutting edges of the knife blades may be blunted by the blade guide surfaces of the housing again.

The typical electrical knife sharpening facilities or devices do not provide any protective structure to protect and to prevent the cutting edge of the knife blade from being blunted after grinding or sharpening processes.

The present invention has arisen to mitigate and/or obviate the afore-described disadvantages of the conventional knife sharpening devices.

SUMMARY OF THE INVENTION

The primary objective of the present invention is to provide a knife sharpener including a knife blade cutting edge protective structure for protecting the cutting edge of the knife blade, and for preventing the cutting edge of the knife blade from-being blunted after grinding or sharpening processes.

In accordance with one aspect of the invention, there is provided a knife sharpener comprising a housing including at least one access slot formed therein for receiving a knife blade to be sharpened, the access slot of the housing including an intermediate portion and two end portions, at least one grinding wheel rotatably received in the housing, and disposed close to the access slot of the housing, for grinding and sharpening a cutting edge of the knife blade, and means for driving the grinding wheel to sharpen the knife blade. The housing includes at least one opening formed therein, and formed in either of the end portions of the access slot of the housing, and communicating with the access slot of the housing, and having a width greater than that of the end portions of the access slot of the housing, for receiving the cutting edge of the knife blade, and for preventing the cutting edge of the knife blade from being engaged with the housing after the cutting edge of the knife blade has been sharpened by the grinding wheel.

The end portions of the access slot of the housing is narrower than the intermediate portion of the access slot of the housing, and the opening of the housing is formed in either of the narrower end portions of the access slot of the housing. The opening of the housing may include various shapes, such as circular shape, or square shape, or rectangular shape.

The opening of the housing is formed in a first end portion of the end portions of the access slot of the housing, and the housing includes a second opening formed in a second end portion of the end portions of the access slot of the housing, and communicating with the access slot of the housing, and having a width greater than that of the end portions of the access slot of the housing, for receiving and protecting the cutting edge of the knife blade.

The second opening of the housing is formed in the narrower second end portion of the access slot of the housing, and may include various shapes, such as circular shape, or square shape, or rectangular shape.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
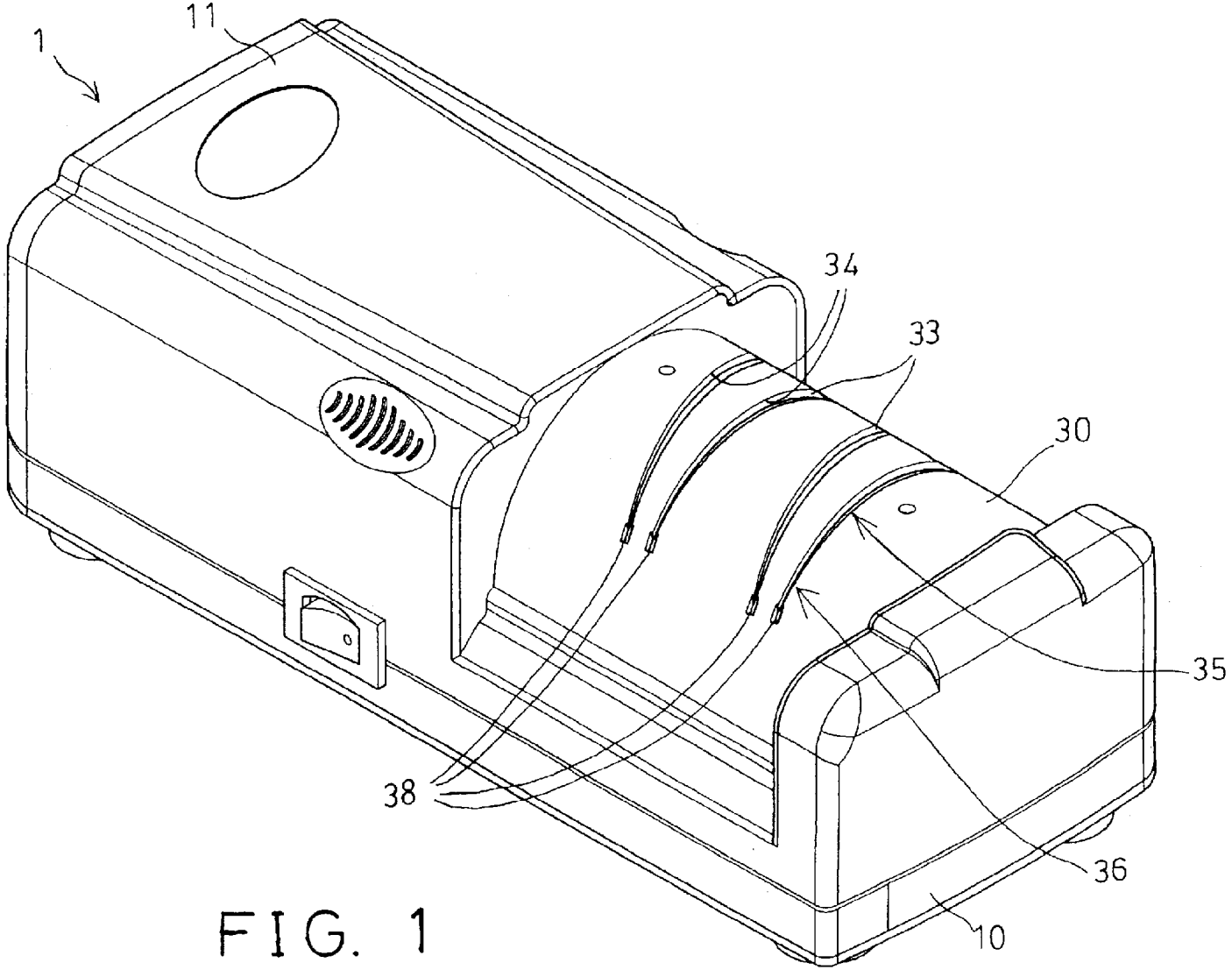
FIG. 1 is a perspective view of a knife sharpener in accordance with the present invention.
Figure 2:
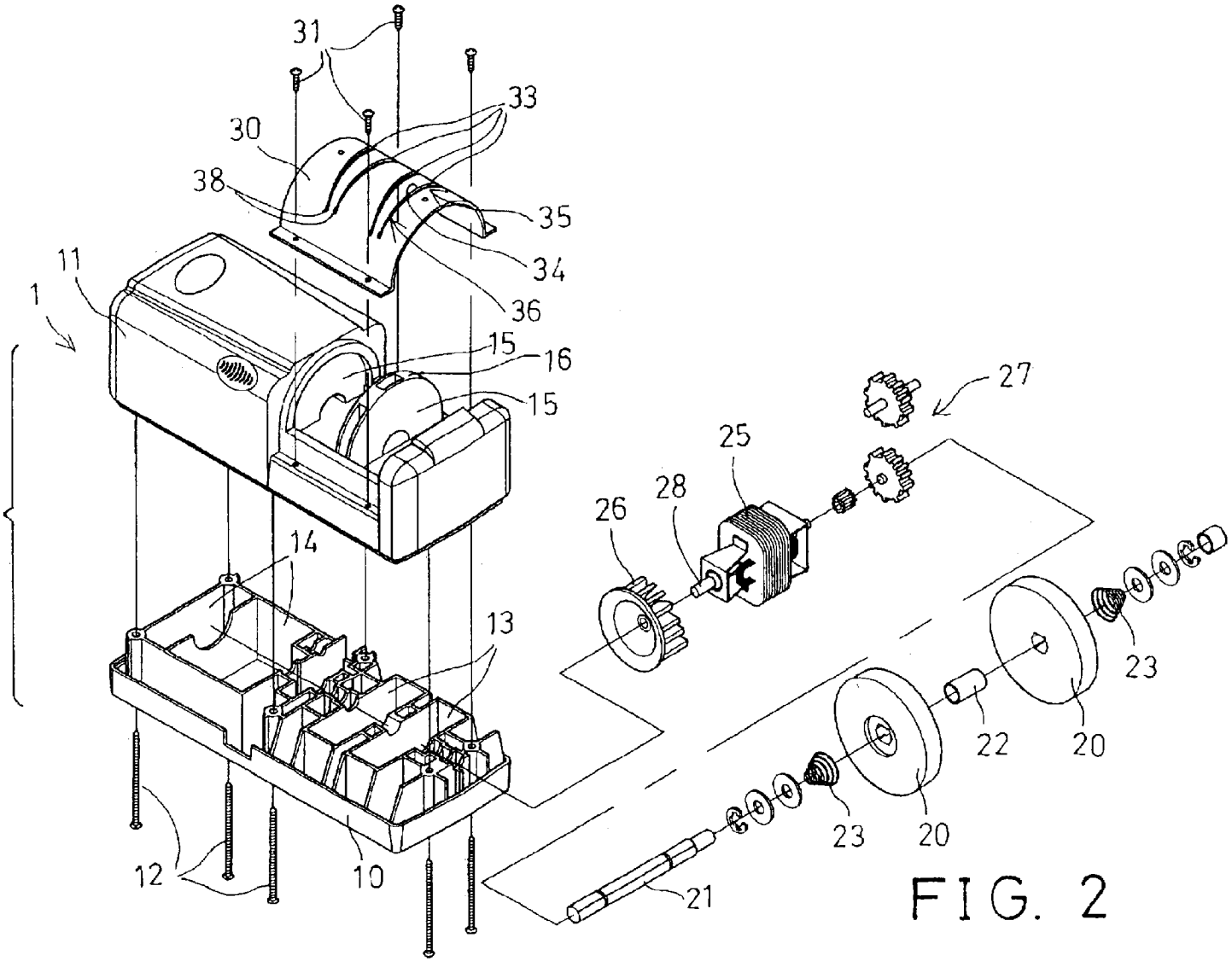
FIG. 2 is a partial exploded view of the knife sharpener.
Figure 3:
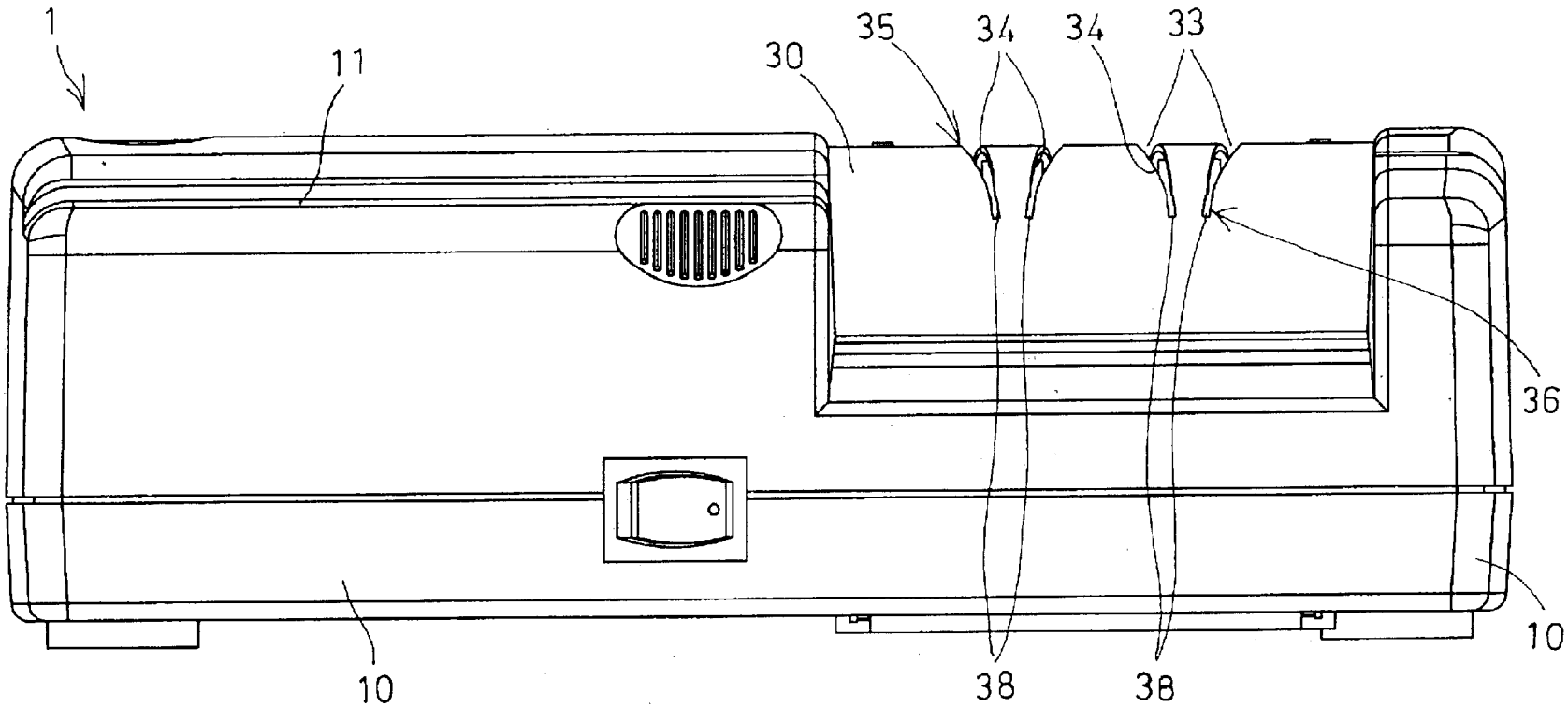
FIG. 3 is a front plan view of the knife sharpener.
Figure 4:
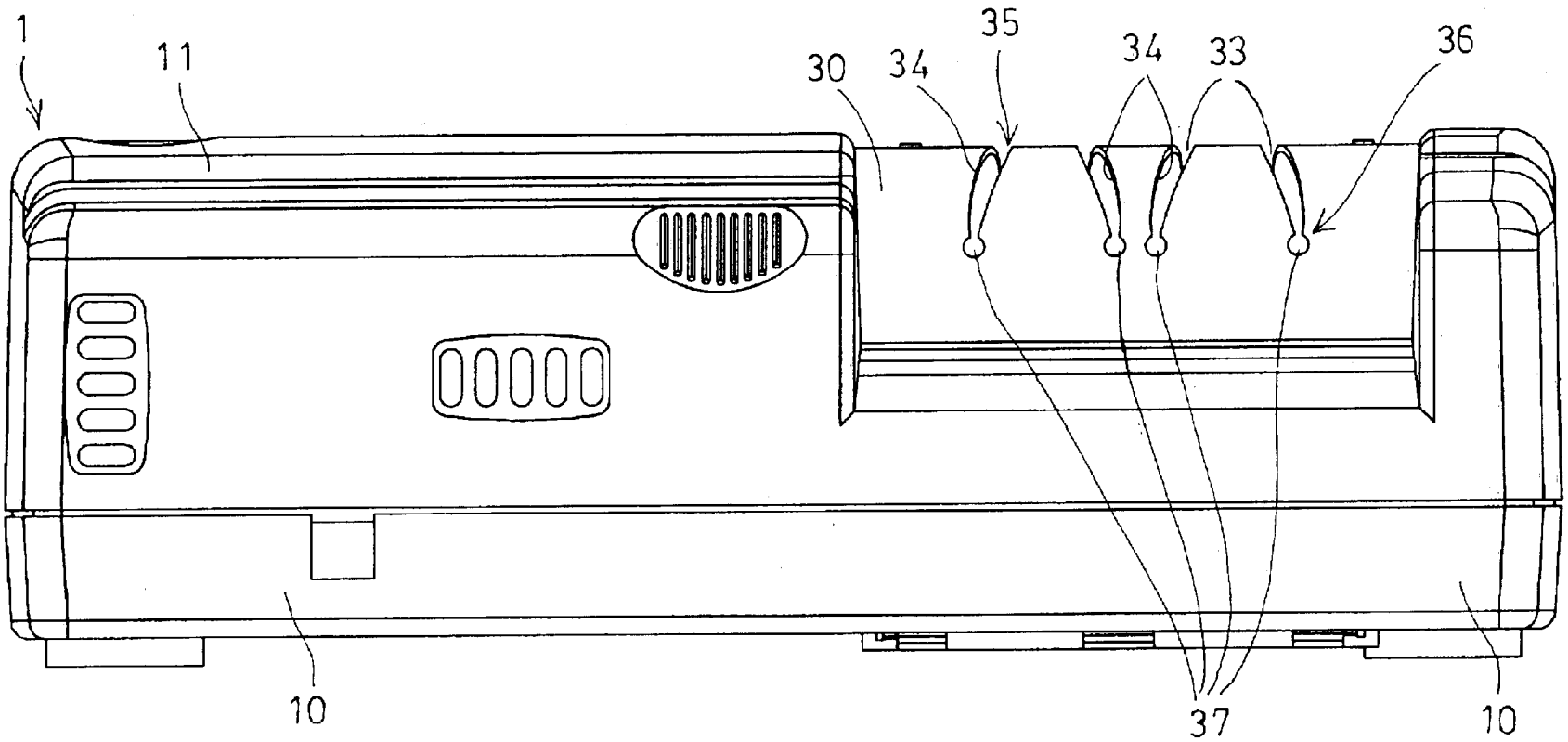
FIG. 4 is a rear plan view of the knife sharpener.
Figure 5:
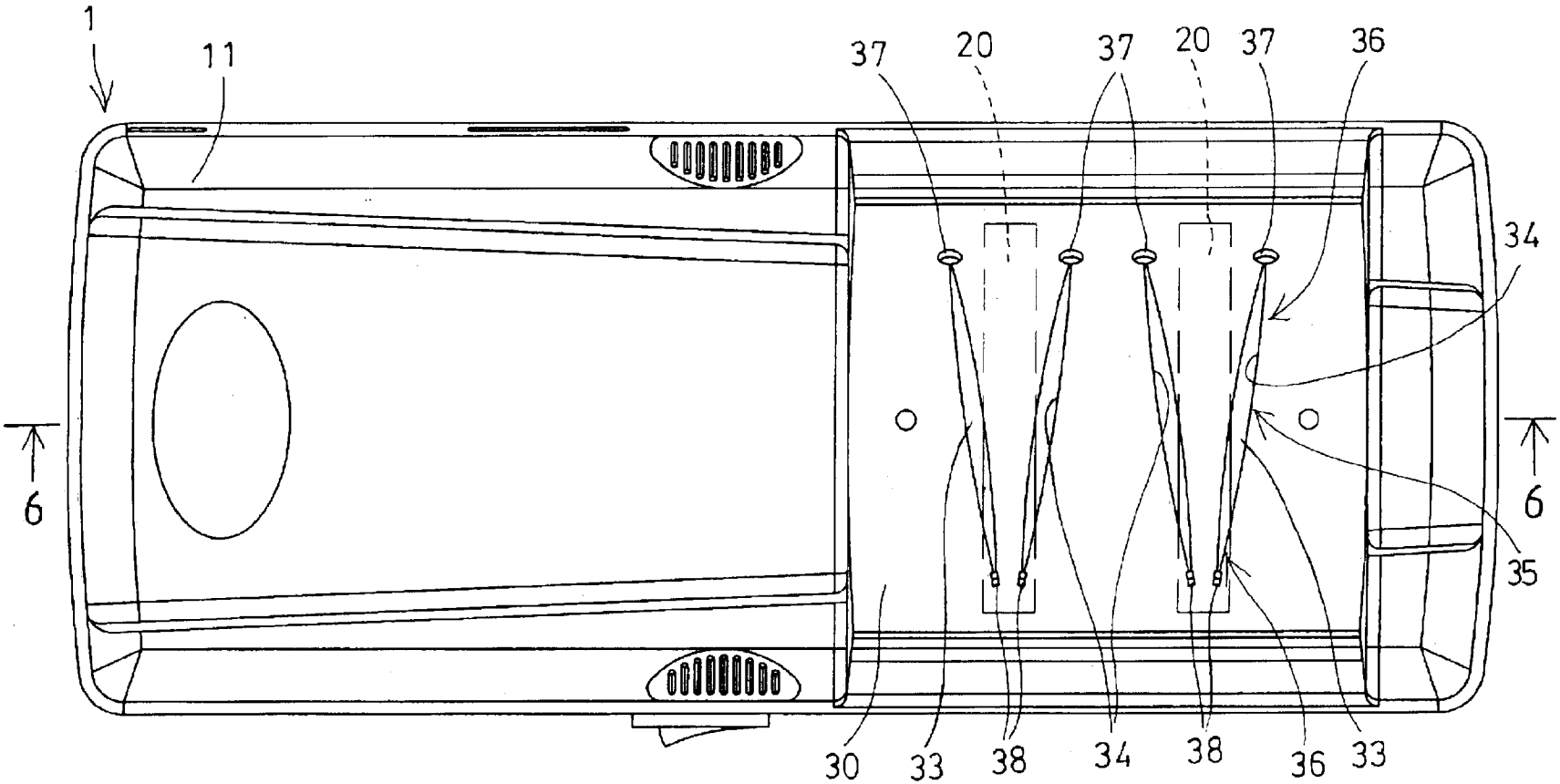
FIG. 5 is a top plan view of the knife sharpener.
Figure 6:
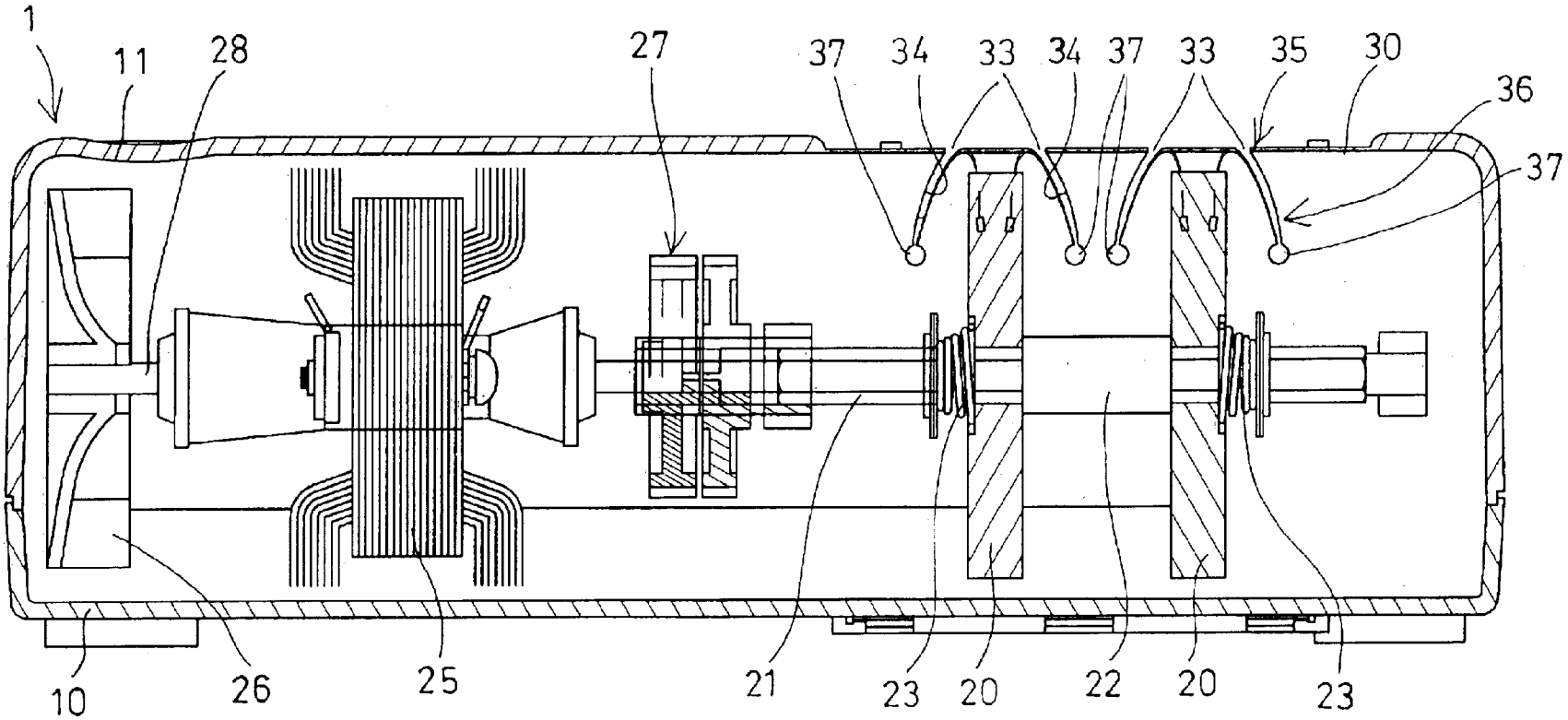
FIG. 6 is a partial cross sectional view of the knife sharpener, taken along lines 6—6 of FIG. 5.

Referring to the drawings, and initially to FIGS. 1–6, a knife sharpener in accordance with the present invention comprises a housing 1 including a base 10 and a casing 11 engaged onto the base 10, and secured to the base 10 with such as fasteners 12, and including one or more spaces 13 formed therein, such as formed in the base 10 and/or in the casing 11, each for rotatably receiving a sharpening or grinding wheel 20 therein.

The grinding wheels 20 may be disposed or engaged on a shaft 21, a spacer 22 may be engaged on the shaft 21 and disposed between the grinding wheels 20, to space the grinding wheels 20 away from each other for a suitable or predetermined distance. One or more spring members 23 may further be provided and engaged on the shaft 21 and engaged with the grinding wheels 20, for applying a spring bias force against the grinding wheels 20, and/or for biasing the grinding wheels 20 against the spacer 22, for example.

The housing 1 further includes one or more chambers 14 formed therein, such as formed in the base 10 and/or in the casing 11, for receiving a motor 25 and/or a reduction gearing 27 and/or a ventilation fan device 26 therein. For example, the reduction gearing 27 and the ventilation fan device 26 may be coupled to two ends of a spindle 28 of the motor 25, and the shaft 21 may be coupled to the motor 25 via the reduction gearing 27, for allowing the shaft 21 and thus the grinding wheels 20 to be rotated or driven by the motor 25.

The housing 1 further includes one or more channels 15 formed therein, such as formed in the casing 11 and defined by one or more partitions 16, for rotatably receiving the sharpening or grinding wheels 20 therein respectively. The housing 1 further includes a shield or cover 30 secured onto such as the casing 11 of the housing 1 with fasteners 31, for example, to enclose the channels 15 of the housing 1, and to shield the grinding wheels 20.

Figure 7:
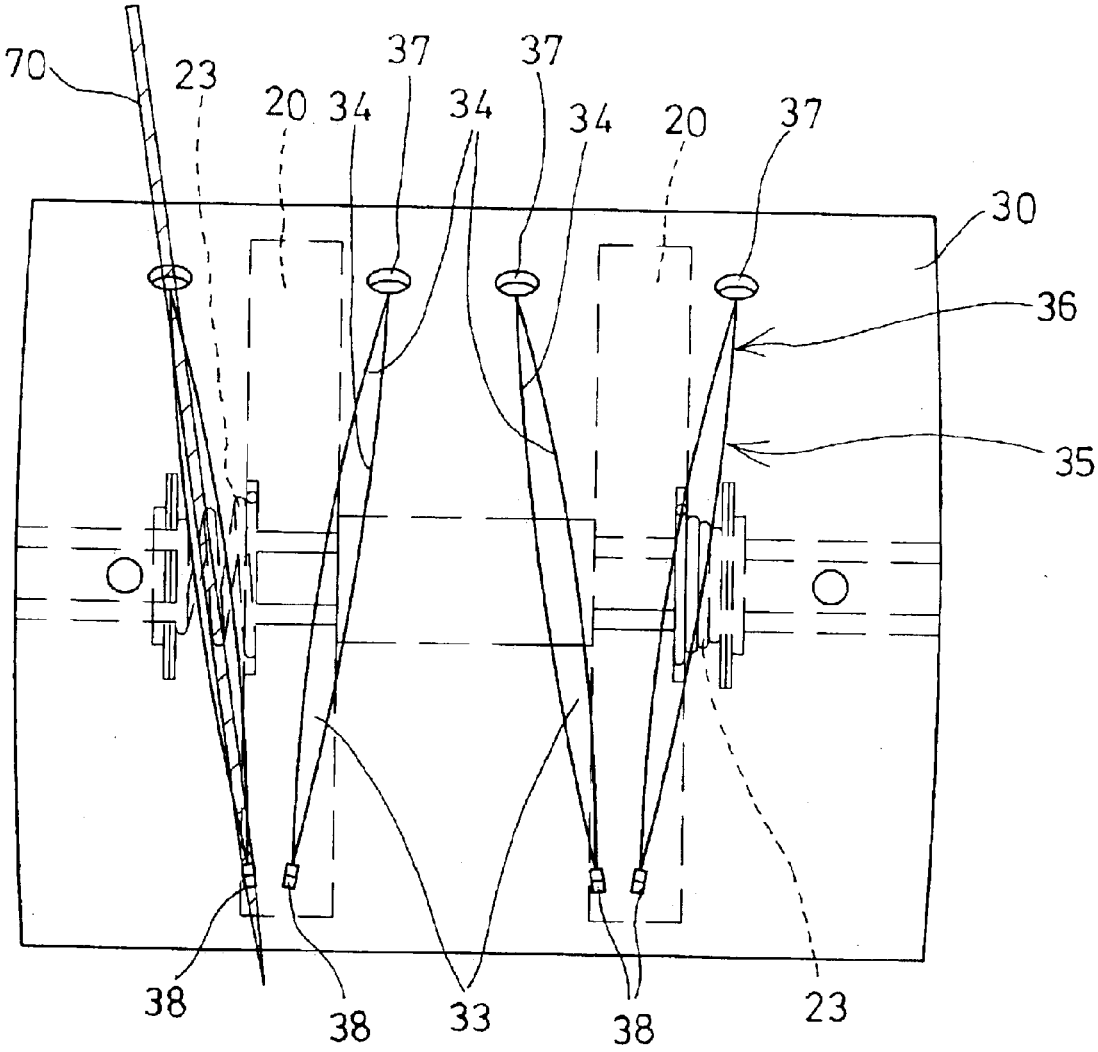
FIG. 7 is a partial top plan schematic view illustrating the operation of the knife sharpener.
Figure 8:
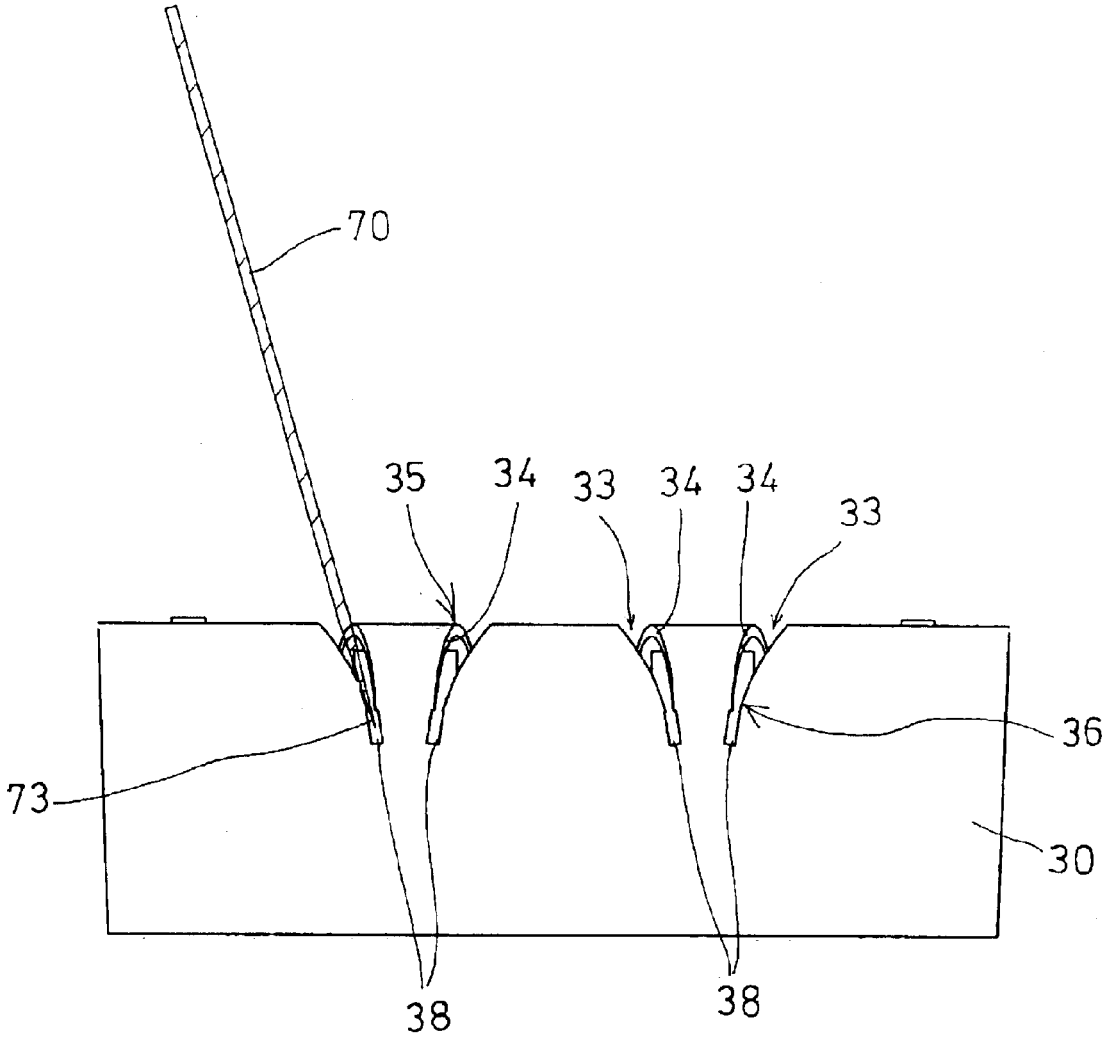
FIG. 8 is a partial front plan schematic view illustrating the operation of the knife sharpener.

The cover 30 includes one or more, such as two pairs of access slots 33 formed therein, and each formed or defined by two blade guide surfaces 34, for receiving the knife blades 70 (FIGS. 7, 8). The access slots 33 and/or the blade guide surfaces 34 are arranged beside or close to the grinding wheels 20, and inclined relative to the grinding wheels 20, for suitably guiding the knife blades 70 through the sharpening or grinding wheels 20, and thus for allowing the knife blades 70 to be suitably sharpened or honed by the grinding wheels 20.

The above-described structure of the knife sharpener is typical and will not be described in further details, and has been disclosed in U.S. Pat. No. 4,807,399 to Friel, U.S. Pat. No. 5,245,789 to Rees et al., U.S. Pat. No. 5,397,262 to Lii, U.S. Pat. No. 6,012,971 to Friel, Sr. et al., and U.S. Pat. No. 6,071,181 to Wightman et al., which are taken as references for the present invention.

Each of the access slots 33 of the housing 1 or of the cover 30 includes a wider intermediate portion 35 formed in the upper portion of the housing 1 or of the cover 30, and includes two narrower end portions 36 formed in the lower portion of the housing 1 or of the cover 30.

The housing 1 further includes one or more openings 37, 38 formed therein, such as formed in either or both of the end portions 36 of each of the access slots 33 of the housing 1 or of the cover 30, and communicating with the respective access slots 33 of the housing 1 or of the cover 30. The openings 37, 38 of the housing 1 or of the cover 30 may include various shapes or configurations, such as the circular shape (37) as shown in FIGS. 4–7, and/or the square or rectangular shape (38) as shown in FIGS. 1–3, 5, 7 and 8.

The openings 37, 38 of the housing 1 or of the cover 30 include a width greater than that of the access slots 33 of the housing 1 or of the cover 30, particularly greater than that of the narrower end portions 36 of the access slots 33 of the housing 1 or of the cover 30, and arranged to receive and to protect the cutting edges 73 of the knife blades 70, and to prevent the cutting edges 73 of the knife blades 70 from being engaged with and blunted by the blade guide surfaces 34 of the housing 1 or of the cover 30, best shown in FIG. 8.

After the cutting edges 73 of the knife blades 70 have been honed or sharpened by the sharpening or grinding wheels 20 and/or after the grinding operations, the sharpened or honed cutting edges 73 of the knife blades 70 may thus be received and protected within the enlarged openings 37, 38 of the housing 1 or of the cover 30, and may thus be prevented from further being blunted by the blade guide surfaces 34 of the housing 1 or of the cover 30.

Accordingly, the knife sharpener in accordance with the present invention includes a knife blade cutting edge protective structure for protecting the cutting edge of the knife blade, and for preventing the cutting edge of the knife blade from being blunted by the housing or cover after grinding or sharpening processes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A knife sharpener comprising:

a housing including at least one access slot formed therein for receiving a knife blade to be sharpened, said at least one access slot of said housing including an intermediate portion and two end portions, at least one grinding wheel rotatably received in said housing, and disposed close to said at least one access slot of said housing, for grinding and sharpening a cutting edge of the knife blade, and means for driving said at least one grinding wheel to sharpen the knife blade, and said housing including at least one opening formed therein, and formed in either of said, end portions of said at least one access slot of said housing, and communicating with said at least one access slot of said housing, and including a width greater than that of said end portions of said at least one access slot of said housing, for receiving the cutting edge of the knife blade, and for preventing the cutting edge of the knife blade from being engaged with said housing after the cutting edge of the knife blade has been sharpened by said at least one grinding wheel.

2. The knife sharpener as claimed in claim 1, wherein said end portions of said at least one access slot of said housing is narrower than said intermediate portion of said at least one access slot of said housing, and said at least one opening of said housing is formed in either of said narrower end portions of said at least one access slot of said housing.

3. The knife sharpener as claimed in claim 1, wherein said at least one opening of said housing includes a circular shape.

4. The knife sharpener as claimed in claim 1, wherein said at least one opening of said housing includes a rectangular shape.

5. The knife sharpener as claimed in claim 1, wherein said at least one opening of said housing is formed in a first end portion of said end portions of said at least one access slot of said housing, and said housing includes a second opening formed in a second end portion of said end portions of said at least one access slot of said housing, and communicating with said at least one access slot of said housing, and having a width greater than that of said end portions of said at least one access slot of said housing, for receiving and protecting the cutting edge of the knife blade.

6. The knife sharpener as claimed in claim 5, wherein said end portions of said at least one access slot of said housing is narrower than said intermediate portion of said at least one access slot of said housing, and said second opening of said housing is formed in said narrower second end portion of said at least one access slot of said housing.

7. The knife sharpener as claimed in claim 5, wherein said second opening of said housing includes a circular shape.

8. The knife sharpener as claimed in claim 5, wherein said second opening of said housing includes a rectangular shape.

* * * * *